US005107625A

United States Patent [19]

Steiner et al.

[11] Patent Number: 5,107,625

[45] Date of Patent: Apr. 28, 1992

[54] PROCESS FOR THE MANUFACTURE OF A PRESS SHELL AND DEVICE FOR THE APPLICATION OF THE PROCESS

[75] Inventors: Karl Steiner, Herbrechtingen; Josef Müllner, Heidenheim; Christian Schiel, Heidenheim; Hans Flämig, Heidenheim, all of Fed. Rep. of Germany

[73] Assignee: J.M. Voith GmbH, Heidenheim, Fed. Rep. of Germany

[21] Appl. No.: 560,571

[22] Filed: Jul. 31, 1990

[30] Foreign Application Priority Data

Aug. 16, 1989 [DE] Fed. Rep. of Germany ..... 3926963

[51] Int. Cl.[5] ..... B24B 41/06

[52] U.S. Cl. ..... 51/216 R; 51/235; 51/323; 51/5 R

[58] Field of Search ..... 51/216 R, 235, 281 R, 51/323, 5 R, 5 A; 493/356; 53/390; 29/110, 130, 423

[56] References Cited

U.S. PATENT DOCUMENTS 3,292,739 12/1966 Hoglund et al. ..... 51/235
4,106,398 8/1978 Buisson ..... 493/356
4,878,407 11/1989 Harrison et al. ..... 51/235

*Primary Examiner*—M. Rachuba
*Attorney, Agent, or Firm*—Baker & Daniels

[57] ABSTRACT

A process for the manufacture of a continuous press shell that is liquid-tight and smoothed on its inside, and which can be used as a press element in a dewatering press is provided. The press shell consists of a continuous wire belt which on its outside is coated with a plastic. Upon the smoothing of its outside, the coated press shell is turned, so that for the use of the press shell its smoothed surface will be on its inside. For turning the press shell, the one continuous edge of the press shell is first turned inward and attached to a traction device. Next, an adjoining and as yet unturned section of the press shell is held back on its outside, by means of vacuum, on a fixed guide device. Lastly, the traction device, along with the edge of the press shell attached to it, is pulled through the interior of the press shell.

13 Claims, 2 Drawing Sheets

26
26

24
23
46
23
25
20
25
24
21
11
10
22
13
45
35
P
34
36
33
43
40
32
44
36
41
31
27
42
12
27
30
28

PROCESS FOR THE MANUFACTURE OF A PRESS SHELL AND DEVICE FOR THE APPLICATION OF THE PROCESS

BACKGROUND OF THE INVENTION

The invention concerns a process for the manufacture of a flexible press shell that is liquid-tight and smoothed on its inside, as well as a device for the application of this process.

A liquid-tight press shell smoothed on its inside serves preferably as a press element in a dewatering press, for instance on a papermaking machine. In doing so, the press shell is forced, with the aid of a press shoe arranged in the press shell, onto part of the circumference of a press roll. The press shell normally consists of a laminated body with a reinforcement fabric embedded in it. Sliding across the press shoe, the inside of the press shell must have a surface that is smooth and impermeable to liquid.

From the German patent document 32 31 039 A1 it is known to form the aforementioned smooth surface first on the outside of a continuous belt and thereafter turn the belt inside out, so that in using the belt the smoothed surface will be located on the inside of the belt.

The aforementioned turning is difficult in the manufacture of such a belt because it involves the risk that the continuous belt may be damaged. This applies especially when the circumference of the belt is relatively small as compared to its width, that is, the space between the two edges. It is quite possible that the circumference of the belt amounts to only one-half of its width. These cases are thus concerned with a tubular belt, which hereafter will be called, as it has already been called above, a "press shell."

The problem underlying the invention is to so advance a manufacturing process for the manufacture of a flexible press shell wherein the shell is liquid-tight and smoothed on its inside, and wherein the smoothing of the press shell takes place on the outside (turned inside out) so that the smoothed side will be the inside, that the turning of the press shell can be performed in a simple manner and without a risk of damage to the press shell. In addition, the problem underlying the invention also comprises proposing a device for the application of this process.

SUMMARY OF THE INVENTION

The problem is inventionally solved through the process and device of the present invention.

A process is provided for the manufacture of a flexible press shell. The press shell has an inside and an outside, and has a continuous edge at each of its axial ends. The press shell is liquid-tight and smoothed on its inside, wherein the smoothing of the inside of the shell takes place while the inside and the outside of the shell are inverted, so that the smoothing takes place from the outside, whereafter the press shell is turned inside out so that the smoothed side is on the inside. The process comprises attaching one of the two continuous edges of the press shell to a traction device while the shell is smoothed on its outside, and turning the edge in a ring-shaped turning zone. The as yet unturned part of the press shell is supported by means of a guide device in at least the area of the turning zone. The press shell is further turned so that the traction device, along with the attached continuous edge of the press shell, moves from the ring-shaped turning zone toward the other of the continuous edges.

A device for the manufacture of a flexible press shell is also provided. The press shell has an inside and an outside, wherein said inside and outside each have a circumference. The press shell has a continuous edge at each axial edge thereof, and is liquid-tight and smoothed on its inside. The smoothing of the inside of the press shell takes place while the inside and outside of the press shell are inverted, so that the smoothing takes place from the outside, whereafter the press shell is turned inside out so that the smoothed side will be on the inside. The device for the manufacture of a flexible press shell comprises a guide device arranged on the outside circumference of the press shell to be manufactured. The guide device has suction openings which act on the outside of the press shell to hold at least a portion of the press shell in the form of an open and continuous loop. A traction device is to be attached to a lower, inwardly turned one of the continuous edges of the shell. The traction device comprises a holding element which has an outside circumference which is slightly smaller than the inside circumference of the press shell that is held back by the guide device. The traction device further comprises at least one mechanical connection element originating from the holding element and extending upwardly through the interior of the press shell, wherein said at least one mechanical connection element is connected to a hoisting gear.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplification set out herein illustrates one preferred embodiment of the invention, in one form, and such exemplifications are not to be construed as limiting the scope of the invention in any manner.

DESCRIPTION OF THE PREFERRED EMBODIMENT

Figure 1:
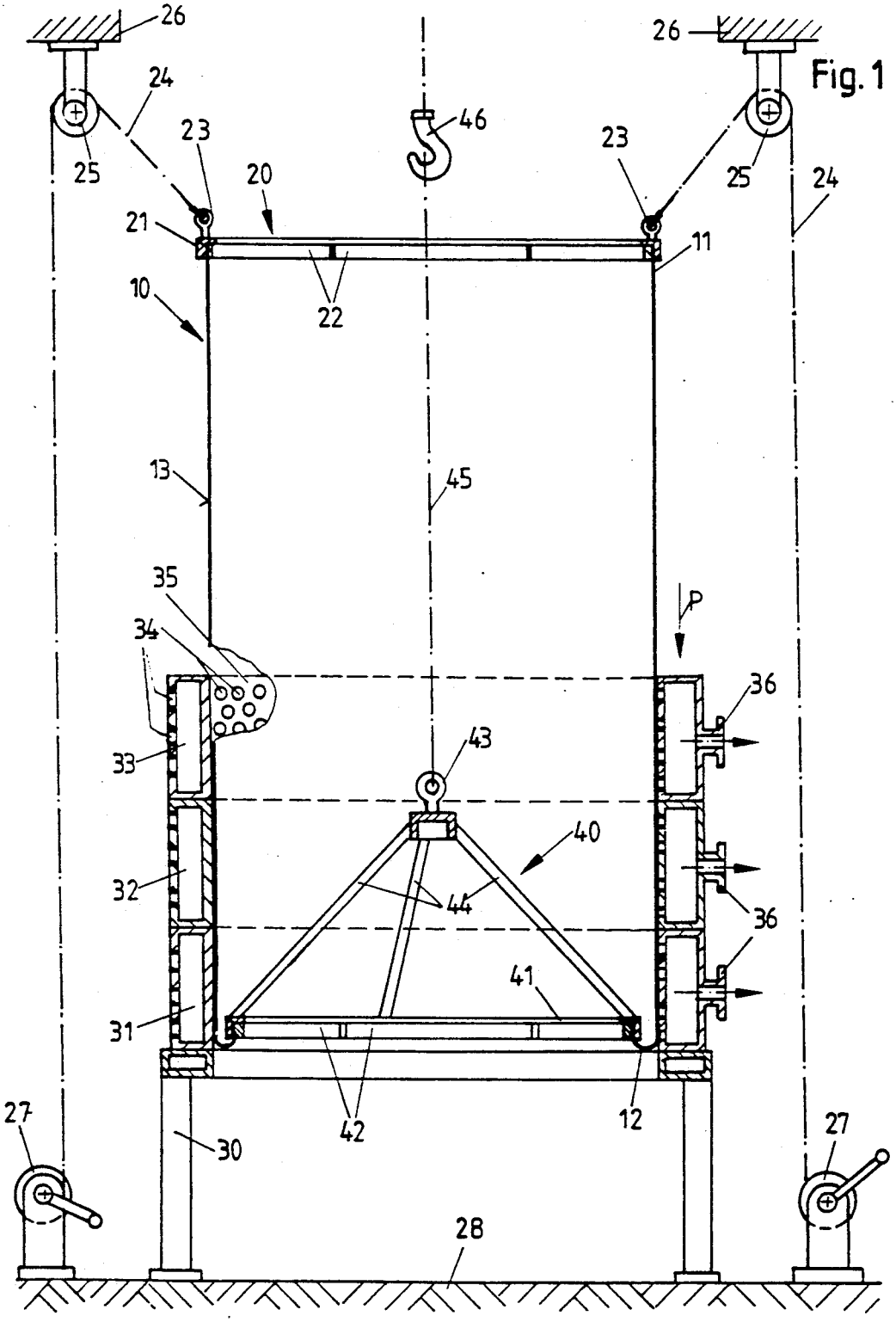
FIG. 1 shows a press shell suspended in a turning device, in a vertical, longitudinal section.

According to FIG. 1, the upper edge 11 of the tubular continuous press shell 10 is just contained in a ring-shaped holder 20. The latter consists of an angular ring 21 on the inside of which the press shell 10 is fastened with the aid of locking sections 22 having the shape of circular segments. The angular ring 21 has suspension eyelets 23 on two opposed points. Hooked into each suspension eyelet is a support cable 24 which runs across a pulley 25 mounted on an overhead beam 26 to a winch 27. The two winches 27 are anchored to the workshop floor 28. With their aid, the press shell 10 can be held at a selected level.

The lower area 12 of the press shell 10 is contained in the interior of a guide device, such as the three ring-shaped and superimposed vacuum chambers 31, 32 and 33. These vacuum chambers are attached to an upright 30 which rests on the workshop floor 28 and is anchored to it. Each vacuum chamber has a cylindrical, preferably circularly cylindrical, inside wall 35 provided with suction openings 34 and its own suction connection 36 to which a (not illustrated) air pump can be connected. Thus, the vacuum chambers 31, 32, 33 can hold onto the lower area of the press shell 10, due to the suction effect which the vacuum chambers exert on the smooth outside 13 of the press shell.

Figure 2:
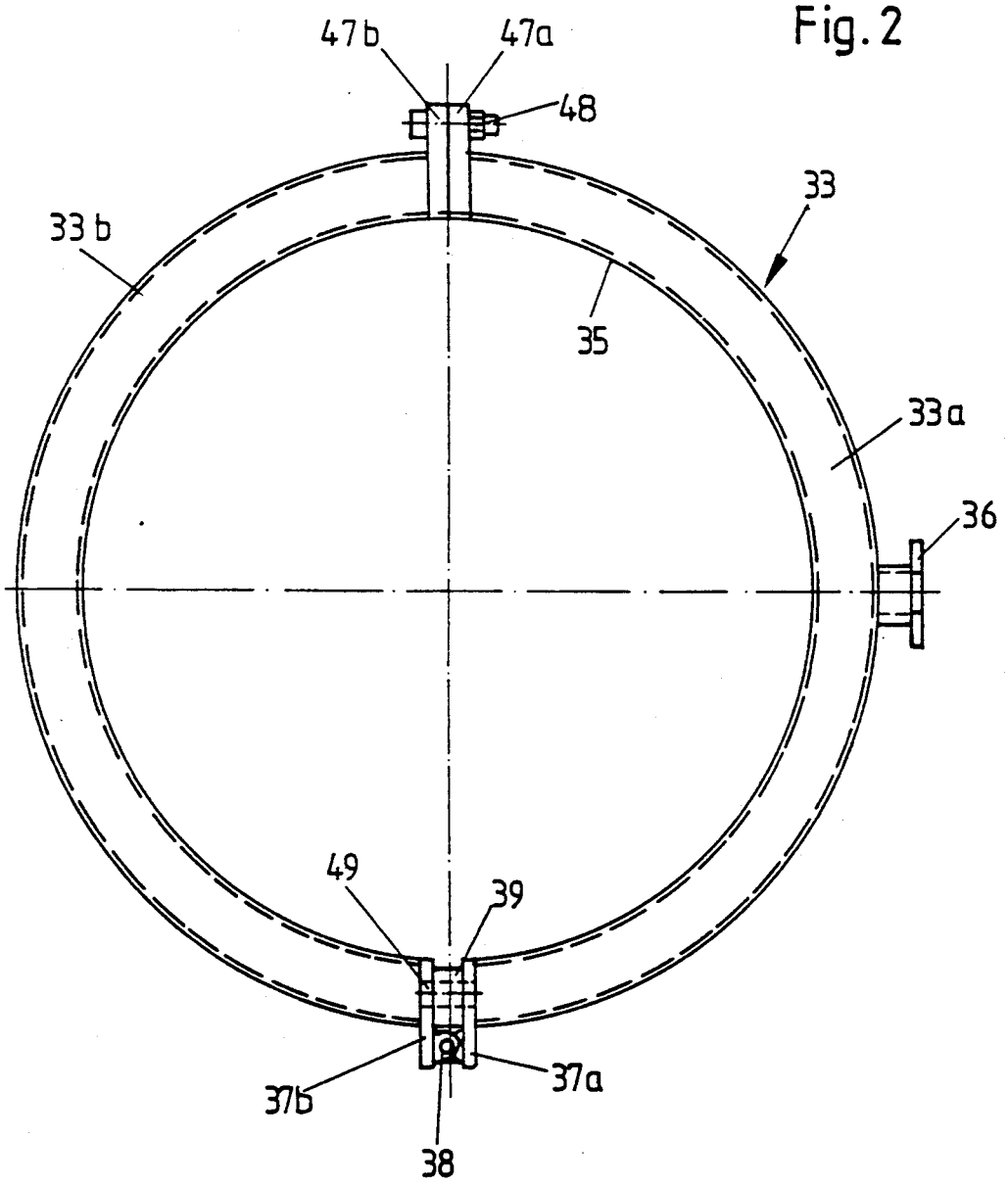
FIG. 2 shows a view on the vacuum chambers pertaining to the turning device, in the direction of arrow P in FIG. 1.

From FIG. 2 it is evident that the vacuum chamber 33 (as well as the other vacuum chambers 32 and 31) is composed of two semi-circular segments 33*a* and 33*b*. At a joint between the two segments, such as the lower joint shown in FIG. 2, each segment has a flange 37*a* and 37*b*, respectively. The two flanges, and thus the two segments 33*a* and 33*b*, are connected with each other by a joint 38 so that the entire vacuum chamber 33 can be folded open. A seal 39 is inserted between the two flanges 37*a* and 37*b*. The interior spaces of the two segments 33*a* and 33*b* are interconnected through a channel 49 which extends through the flanges 37*a* and 37*b* and through the seal 39. Thus, despite the joint 38, only a single vacuum connection 36 is required. At the other joint between the two segments 33*a* and 33*b*, such as the upper joint shown in FIG. 2, each segment has another flange 47*a* and 47*b*, respectively. Here, the two segments can be connected with each other by means of a screw 48. The press shell to be turned and the remaining parts of the turning device have been omitted in FIG. 2.

The manufacturing process for the tubular continuous press shell 10, to begin with, comprises the known operations:

Weaving and making continuous a tubular wire belt; coating the wire belt on its outside with a plastic which is flexible in cured condition; smoothing the outside 13 of the coated press shell 10, for instance by grinding.

The objective being the turning of the press shell 10, the subsequent process steps are performed in the described device. To that end, the press shell 10, as illustrated in FIG. 1, is suspended by means of the holder 20. To do so, the vacuum chambers 31-33 can be temporarily folded open, if required. Next, the bottom edge 12 of the press shell is turned over inside and up. This can be facilitated by numerous recesses distributed along the edge (sawtooth shape of the edge 12). Turned this way, the edge 12 is now attached to a traction device 40 which is inserted in the interior of the press shell 10. Among other things, the traction device 40 features a preferably circular angular ring 41 whose outside diameter is smaller than the inside diameter of the vacuum chambers 31-33 by just as much as to just leave a certain space between the outside circumference of the ring and the inside surface of the press shell 10. The traction device 40 consists additionally of locking parts 42 having the shape of ring segments and of, for example, mechanical connection elements, such as a centrally arranged pulling eyelet 43 which through pull rods 44, or corresponding cables, is connected with the angular ring 41. This makes it possible to suspend the entire traction device 40 by means of a cable 45 on a hoist 46, for instance the hook of a workshop hoist, with the cable 45 running right through the center of the tubular press shell 10 upward.

As the press shell 10 is now held back on the vacuum chambers 31, 32, 33 and the bottom edge 12 of the press shell 10 is pulled upward by means of the traction device 40, the previous outside now proceeds inside, with the press shell separating, at the ring-shaped turning zone in the drawing at 12, first from the lower vacuum chamber 31, then also from the center 32 and finally, in part, from the upper chamber 33. The entire turning process is subdivided in individual steps, i.e., the bottom edge 12 is first pulled only far enough for the press shell 10 to just be held back yet by the topmost vacuum chamber 33. Next, the vacuum is turned off and the entire press shell 10, now in partly turned condition, is moved down until the ring-shaped turning zone 12 arrives again at the bottom edge of the lower vacuum chamber. To do so, the two winches 27 and the hoist 46 are operated simultaneously. Besides, the vacuum chambers 31-33 can again be folded open briefly. The turning operation continues after turning the vacuum back on.

From the drawing and device claims it is evident that the turning of the press shell 10 takes place preferably in vertical direction, especially for reason of saving space. However, the process can also be performed in horizontal direction. It is especially advantageously suited for turning the aforementioned tubular press shells but, if required, also for the turning of press shells whose circumference is rather large relative to their width.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for the manufacture of a flexible press shell of the type wherein said press shell has an inside and an outside, said inside and said outside each having a circumference, said press shell further having a continuous edge at each axial end thereof, said press shell being liquid-tight and smoothed on its inside, wherein said smoothing of said inside of said press shell takes place while said inside and outside of said press shell are inverted so that said smoothing takes place from outside, whereafter said press shell is turned inside out so that said smoothed side will be inside, said device comprising:

a guide device arranged on the outside press shell to be manufactured, said guide device having suction openings which act on said outside of the press shell to hold at least a portion of said shell back in the form of an open and continuous loop;

a traction device to be attached to a lower, inwardly turned one of said continuous edges of said press shell, said traction device comprising a holding element having an outside circumference slightly smaller than said inside circumference of the portion of said press shell held back by said guide device; said traction device further comprising at least one mechanical connection element originating from said holding element and extending upwardly through a space disposed interiorly of said press shell, wherein said at least one mechanical connection element is connected to a hoisting gear.

2. A device as described in claim 1, wherein said guide device comprises a ring-shaped vacuum chamber.

3. A device as described in claim 2, wherein said ring-shaped vacuum chamber is divided into at least two segments, said segments being separable from one another.

4. A device as described in claim 1, in which said guide device includes a plurality of groups of suction openings, said groups being positioned on top of one another, each of said groups further being adapted to be connected to suction devices independently of the remainder of said plurality of groups of suction openings.

5. A device as described in claim 2, in which said guide device includes a plurality of groups of suction openings, said groups being positioned on top of one another, each of said groups further being adapted to be connected to suction devices independently of the remainder of said plurality of groups of suction openings.

6. A device as described in claim 1, wherein said guide device comprises at least two superposed ring-shaped vacuum chambers, each of said vacuum chambers having a respective vacuum connection.

7. A device as described in claim 4, wherein said guide device comprises at least two superposed ring-shaped vacuum chambers, each of said vacuum chambers having a respective vacuum connection.

8. A device as described in claim 6, wherein each of said vacuum chambers is divided into at least two segments, said segments being separable from one another.

9. A device as described in claim 7, wherein each of said vacuum chambers is divided into at least two segments, said segments being separable from one another.

10. A device as described in claim 8, wherein said superposed segments are combined to an integral component.

11. A device as described in claim 3, in which said ring-shaped vacuum chamber is divided into two segments, wherein said segments may be interconnected though a joint.

12. A device as described in claim 8, in which each of said vacuum chambers is divided into two segments, wherein said segments may be interconnected through a joint.

13. A device as described in claim 1, in which said guide device has a height effective for holding said press shell, wherein said height comprises only a fraction of the distance between the respective continuous edges of said press shell, said press shell being vertically aligned and having an upper area and a lower area, each of said areas being adjacent a respective one of said continuous edges whereby said continuous edges comprise respective upper and lower edges, said guide device being coordinated with said lower area, and wherein said device for the manufacture of a flexible press shell further includes a suspending device, said suspending device having at least one holding element for holding said upper continuous edge of said press shell.

* * * * *